US006263605B1

(12) United States Patent
Vanell

(10) Patent No.: US 6,263,605 B1
(45) **Date of Patent: *Jul. 24, 2001**

(54) PAD CONDITIONER COUPLING AND END EFFECTOR FOR A CHEMICAL MECHANICAL PLANARIZATION SYSTEM AND METHOD THEREFOR

(75) Inventor: James F. Vanell, Tempe, AZ (US)

(73) Assignee: Motorola, Inc., Schaumburg, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/216,820

(22) Filed: Dec. 21, 1998

(51) Int. Cl.[7] ..... B24B 19/00
(52) U.S. Cl. ..... 41/443; 451/72; 451/41
(58) Field of Search ..... 451/443, 72, 41

(56) References Cited

U.S. PATENT DOCUMENTS 5,157,871 * 10/1992 Gawa et al. ..... 451/5
5,667,433 * 9/1997 Mallon ..... 451/287
5,681,215 * 10/1997 Sherwood et al. ..... 451/388
5,683,289 * 11/1997 Hempel, Jr. ..... 451/56
5,779,526 * 7/1998 Gill ..... 451/324
5,794,484 * 8/1998 Jaddou ..... 72/414
5,803,444 * 9/1998 Shibuya et al. ..... 267/180
5,804,507 * 9/1998 Perlov et al. ..... 438/692
5,806,132 * 9/1998 Kelley ..... 15/230.17
5,947,144 * 9/1999 Mangano et al. ..... 137/81.1

* cited by examiner

*Primary Examiner*—Allen Ostrager
*Assistant Examiner*—William Hong
(74) *Attorney, Agent, or Firm*—A. Kate Huffman; Robert F. Hightower

(57) ABSTRACT

A pad conditioner coupling (58) holds an end effector (57) for abrading a polishing media surface. Pad conditioning planarizes the polishing media surface, removes particulates, and roughens the polishing media surface to promote the transport of polishing slurry. Pad conditioner coupling (58) comprises shoulder screws (50), polymer bearings (51), a static plate (52), a wave spring (54), and a floating plate (55). Wave spring (54) is placed between static plate (52) and floating plate (55). The shoulder screws (50) connect through the static plate (52) and fasten to the floating plate (55) to hold the wave spring (54) in a preloaded condition. The polymer bearings (51) prevent the shoulder screws (50) from contacting the static plate (52). Wave spring (54) allows the floating plate (55) to move in a non-parallel position to the static plate (52) for angular compensation in the pad conditioning process.

12 Claims, 4 Drawing Sheets

PAD CONDITIONER COUPLING AND END EFFECTOR FOR A CHEMICAL MECHANICAL PLANARIZATION SYSTEM AND METHOD THEREFOR

BACKGROUND OF THE INVENTION

The present invention relates, in general, to chemical mechanical planarization (CMP) systems, and more particularly, to a pad conditioner coupling and end effector for a CMP tool.

Chemical mechanical planarization (also referred to as chemical mechanical polishing) is a proven process in the manufacture of advanced integrated circuits. CMP is used in almost all stages of semiconductor device fabrication. For example, chemical mechanical planarization allows the creation of finer structures via local planarization and for global wafer planarization to produce high density vias and interconnect layers. Materials that undergo CMP in an integrated circuit manufacturing process include single and polycrystalline silicon, oxides, nitrides, polyimides, aluminum, tungsten, and copper.

In general, semiconductor wafer polishing occurs on a rotating disk known as a platen. The rotating disk is a support structure for the polishing process. A polishing media is placed on the platen. The polishing media is compliant and allows the transport of a chemical/abrasive slurry. One type of polishing media is a polyurethane pad. The polyurethane pad includes grooves or indentations to promote slurry transport.

A polishing process begins with polishing slurry being applied to the polishing media surface. A semiconductor wafer is brought in contact with and coplanar to the surface of the polishing media. A predetermined force is applied to the semiconductor wafer to chemically and abrasively remove a portion of the surface of the processed wafer. Typically, the semiconductor wafer and the platen are rotated during the polishing process. Polishing slurry is continuously provided to the polishing media during the polishing process. Particulates from the semiconductor wafer and spent polishing slurry become trapped and build up as semiconductor wafers are polished. This results in the surface of the polishing media being non-uniform. The particulates can also scratch and damage the surface of the semiconductor wafer.

Pad conditioning is a process to remove particulates and spent polishing slurry from a polishing media. Pad conditioning also planarizes the pad by selectively removing pad material, and roughens the surface of the polishing media. Prior art, pad conditioning apparatus move an abrasive material across the surface of the polishing media. One commonly used pad conditioning apparatus includes a disk having a collet connected to an upper surface of the disk. An abrasive disk is adhesively or mechanically attached to a bottom surface of the disk exposing an abrasive surface. A coil cut is made in the collect to give the pad conditioning apparatus some angular compliance. A motor shaft connects to the collet of the pad conditioning apparatus. Rotating both the pad conditioning apparatus and the polishing media during a pad conditioning process achieves the best results. Typically, the pad conditioning process is performed after a series of wafers have been polished. In particular, the polishing media is conditioned after a wafer lot has been processed due to the time required for the operation.

Three problems arise from this style of pad conditioning apparatus. First, the coil cut in the collet of the pad conditioning apparatus is not effective in maintaining the abrasive surface parallel to the surface of the polishing media (angular compliance). The result is a non-uniform surface on the polishing media which directly impacts the semiconductor wafer polishing uniformity. For example, the pad conditioning apparatus could chatter during a pad conditioning process under certain operating conditions leading to high and low spots across the polishing media. Second, the downforce applied to the pad conditioning apparatus can completely close the coil cut into the collet, effectively obviating the compliance function with resulting loss of polishing pad flatness. Third, the pad conditioning apparatus periodically fails causing increased maintenance of the CMP tool. The downtime translates to increased cost and lower wafer throughput of the factory. The failure mechanism occurs when the abrasive surface catches an edge which places extreme torque on the coil cut collet. The collet eventually fails in tension and comes apart. The pad conditioning apparatus can come apart with such force that other components of the CMP tool can be damaged.

Accordingly, it would be advantageous to have a pad conditioning apparatus for a chemical mechanical planarization tool that has improved reliability in a manufacturing environment and increases polishing uniformity across a semiconductor wafer. It would be of further advantage if the pad conditioning apparatus was inexpensive and allowed easy replacement of the abrasive surface during normal maintenance.

DETAILED DESCRIPTION OF THE DRAWINGS

In general, chemical mechanical planarization (CMP) is used to remove material or a global film from a processed side of a semiconductor wafer. Ideally, a uniform amount of material is removed across the semiconductor wafer leaving a highly planar surface on which to continue wafer processing. Any non-uniformity in the polishing process may result in a loss of yield or long term device reliability problems. Uniformity is the measure of variation in surface height across a semiconductor wafer. Some common types of chemical mechanical planarization processes in the semiconductor industry are used to remove oxides, polysilicon, tungsten, and copper.

Chemical mechanical planarization tools currently used in the semiconductor industry are capable of achieving wafer uniformity in the range of 6–12 percent. This level of uniformity is sufficient for building devices having critical dimensions in the range of 0.18–0.35 microns. In the future, polishing uniformity in the range of 1–3 percent will be required as the semiconductor industry moves towards critical dimensions of 0.10 microns and below. An area that has been identified as having a significant impact on wafer uniformity is the polishing media on which a semiconductor wafer is polished. The polishing media surface must remain planar and support the transport of the polishing slurry to achieve consistent wafer uniformity. The complexity of the planarization problem is further exacerbated by an increase in wafer diameter. The semiconductor industry is in the process of converting from 200 millimeter wafer diameters to 300 millimeter wafer diameters.

Figure 1:
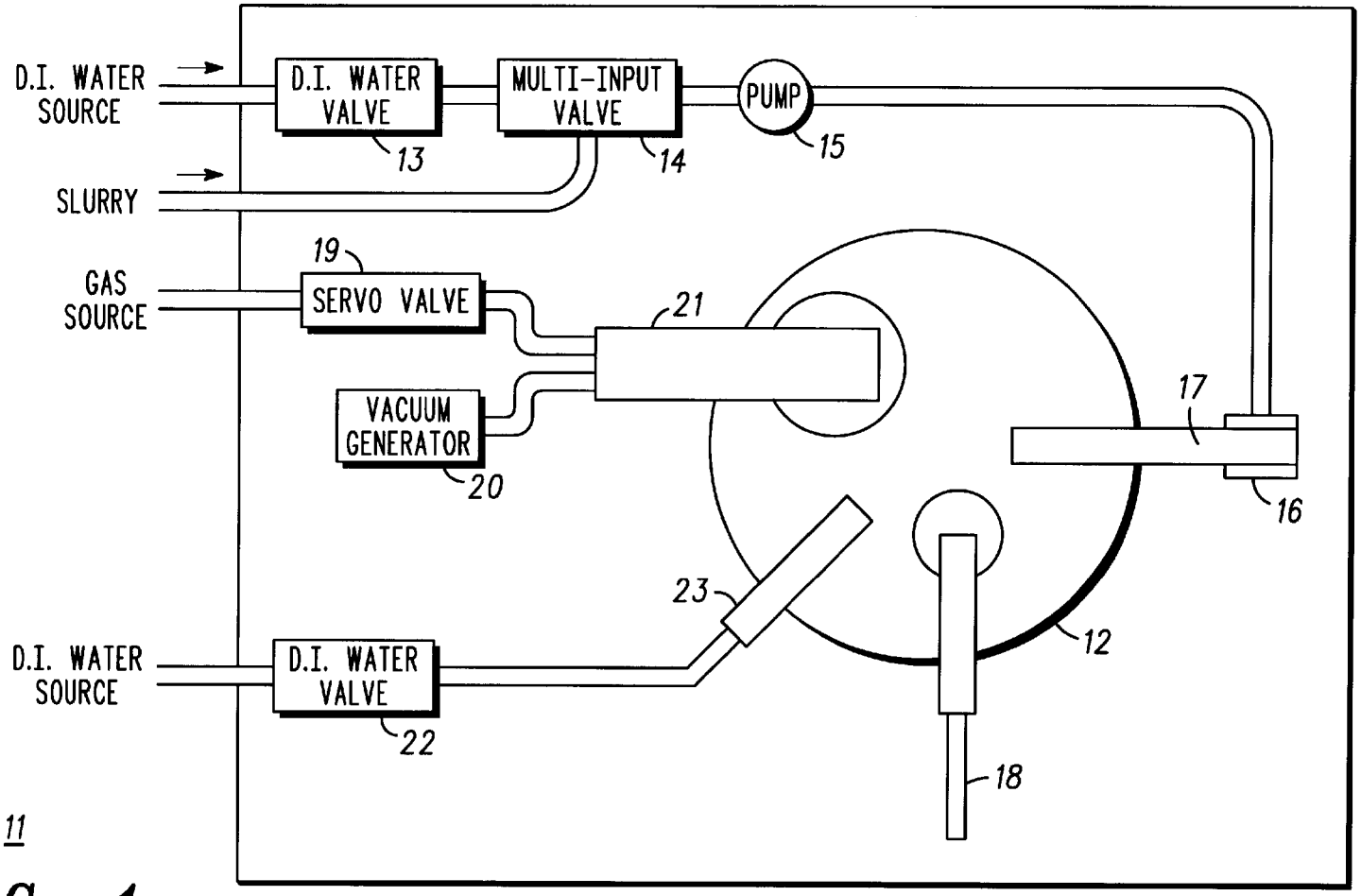
FIG. 1 is a top view of a chemical mechanical planarization (CMP) tool in accordance with the present invention.

FIG. 1 is a top view of a chemical mechanical planarization (CMP) tool 11 for improving the uniformity of a polished semiconductor wafer in accordance with the present invention. CMP tool 11 comprises a platen 12, a deionized (DI) water valve 13, a multi-input valve 14, a pump 15, a dispense bar manifold 16, a dispense bar 17, a conditioning arm 18, a servo valve 19, a vacuum generator 20, a wafer carrier arm 21, and a deionized (DI) water valve 22, and a spray bar 23.

Platen 12 supports various polishing media and chemicals used to planarize a processed side of a semiconductor wafer. Platen 12 is typically made of metal such as aluminum or stainless steel. A motor (not shown) couples to platen 12. Platen 12 is capable of rotary, orbital, or linear motion at user-selectable surface speeds.

Deionized water valve 13 has an input and an output. The input is connected to a DI water source. Control circuitry (not shown) enables or disables DI water valve 13. DI water is provided to multi-input valve 14 when DI water valve 13 is enabled. Multi-input valve 14 allows different materials to be pumped to dispense bar 17. An example of the types of materials which are input to multi-input valve 14 are chemicals, slurry, and deionized water. In an embodiment of CMP tool 11, multi-input valve 14 has a first input connected to the output of DI water valve 13, a second input connected to a slurry source, and an output. Control circuitry (not shown) disables all the inputs of multi-input valve 14 or enables any combination of valves to produce a flow of selected material to the output of multi-input valve 14.

Pump 15 pumps material received from multi-input valve 14 to dispense bar 17. The rate of pumping provided by pump 15 is user-selectable. Minimizing flow rate variation over time and conditions permits the flow to be adjusted near the minimum required flow rate, which reduces waste of chemicals, slurry, or DI water. Pump 15 has an input connected to the output of multi-input valve 14 and an output.

Dispense bar manifold 16 allows chemicals, slurry, or DI water to be routed to dispense bar 17. Dispense bar manifold 16 has an input connected to the output of pump 15 and an output. An alternate approach utilizes a pump for each material being provided to dispense bar 17. For example, chemicals, slurry, and DI water each have a pump that connects to dispense bar manifold 16. The use of multiple pumps allows the different materials to be precisely dispensed in different combinations by controlling the flow rate of each material by its corresponding pump. Dispense bar 17 distributes chemicals, slurry, or DI water onto a polishing media surface. Dispense bar 17 has at least one orifice for dispensing material onto the polishing media surface. Dispense bar 17 is suspended above and extends over platen 12 to ensure material is distributed over the majority of the surface of the polishing media.

Wafer carrier arm 21 suspends a semiconductor wafer over the polishing media surface. A wafer carrier is connected to wafer carrier arm 21. The wafer carrier is an assembly for holding the semiconductor wafer process side down and maintaining a surface of the semiconductor wafer planar to the surface of the polishing media during the polishing process. Wafer carrier arm 21 applies a user-selectable downforce onto the polishing media surface. In general, wafer carrier arm 21 is capable of rotary motion as well as a linear motion. The semiconductor wafer is held onto the wafer carrier by vacuum. Wafer carrier arm 21 has a first input and a second input.

Vacuum generator 20 is a vacuum source for wafer carrier arm 21. Vacuum generator 20 generates and controls vacuum used for wafer pickup by the wafer carrier. Vacuum generator 20 is not required if a vacuum source is available from the manufacturing facility. Vacuum generator 20 has a port connected to the first input of wafer carrier arm 21. Servo valve 19 provides a gas to wafer carrier arm 21 for wafer ejection after the planarization is complete. The gas is also used to put pressure on the backside of a wafer during planarization to control the wafer profile. In an embodiment of CMP tool 11, the gas provided to wafer carrier arm 21 is nitrogen. Servo valve 19 has an input connected to a nitrogen source and an output connected to the second input of wafer carrier arm 21.

Conditioning arm 18 is used to apply an abrasive end effector onto a surface of the polishing media. In an embodiment of conditioning arm 18, the abrasive end effector is drawn linearly across the surface of the polishing media. The speed at which the end effector is drawn across the polishing media surface is variable to compensate for the different friction rates due to the changing velocity of the rotating polishing media as the end effector moves from an outer area to an inner area. The abrasive end effector planarizes the polishing media surface and cleans and roughens the surface to aid in chemical transport. Conditioning arm 18 typically is capable of both rotational and translational motion. The pressure or downforce that the end effector applies to the surface of the polishing media is controlled by conditioning arm 18.

DI water valve 22 has an input connected to a DI water source and an output connected to an input of spray bar 23. Spray bar 23 includes a series of spray nozzles that are angled to remove material from the polishing media surface. Activating DI water valve 22 enables water to flow to spray bar 23 and out of the spray nozzles. Spray bar 23 allows the removal of spent polishing slurry and particulates during a polishing process or an insitu pad conditioning process.

Figure 2:
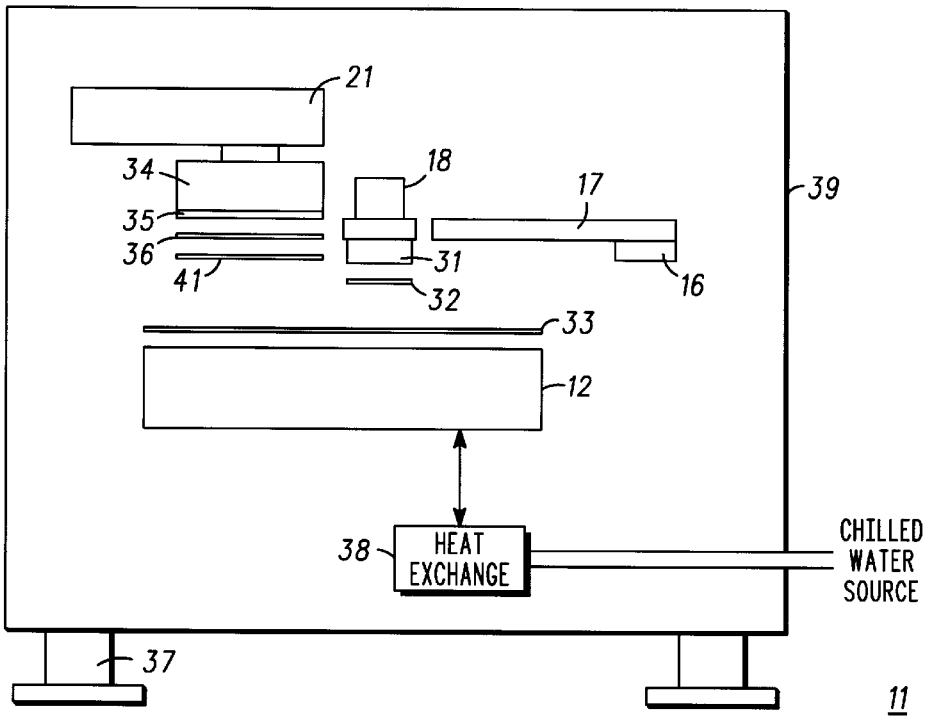
FIG. 2 is a side view of the CMP tool of FIG. 1.

FIG. 2 is a side view of the chemical mechanical planarization (CMP) tool 11 shown in FIG. 1. Conditioning arm 18 is shown with a pad conditioner coupling 31 and an end effector 32. Wafer carrier arm 21 is shown with a carrier assembly 34, a carrier ring 35, a carrier film 36, and a semiconductor wafer 41. CMP tool 11 further includes a polishing media 33, machine mounts 37, a heat exchanger 38, and an enclosure 39.

Polishing media 33 is placed on platen 12. Typically, polishing media 33 is attached to platen 12 using a pressure sensitive adhesive. Polishing media 33 provides a suitable surface upon which to introduce a polishing chemistry. Polishing media 33 provides for chemical transport and micro-compliance for both global and local wafer surface irregularities. Typically, polishing media 33 is a polyurethane pad, which is compliant and includes small perforations or annular groves throughout the exposed surface to aid in chemical transport.

Carrier assembly 34 connects to wafer carrier arm 21. Carrier assembly 34 provides a foundation with which to rotate semiconductor wafer 41 in relation to platen 12. Carrier assembly 34 also puts a downward force on semiconductor wafer 41 to hold it against polishing media 33. A motor (not shown) allows user controlled rotation of carrier assembly 34. Carrier assembly 34 includes vacuum and gas pathways to hold semiconductor wafer 41 during planarization, profile semiconductor wafer 41, and eject semiconductor wafer 41 after planarization.

In general, carrier assembly 34 is designed to provide angular compensation. Carrier arm 21 cannot bring the surface of semiconductor wafer 41 exactly planar to the surface of polishing media 33. Planar contact between the surfaces of semiconductor wafer 41 and polishing media 33 is essential to polishing uniformity. One type of carrier assembly 34 that compensates for angular differences between the polishing surfaces allows semiconductor wafer 41 to incline freely in relation to carrier arm 21. Semiconductor wafer 41 contacting polishing media 33 forces carrier assembly 34 to incline to a position where the two surfaces are planar to one another.

Carrier ring 35 and carrier film 36 respectively retain and hold semiconductor wafer 41 during the polishing process. Carrier ring 35, as it name implies, is a ring having an inner diameter approximately equal to the diameter of semiconductor wafer 41. The ring is connected to carrier assembly 34. Carrier ring 35 aligns semiconductor wafer 41 concentrically to carrier assembly 34 and physically constrains semiconductor wafer 41 from moving laterally. Carrier film 36 is a component of the support structure of carrier assembly 34. Carrier film 36 provides a surface for semiconductor wafer 41 with suitable frictional characteristics to prevent rotation due to slippage in relation to carrier assembly 34 during planarization. In addition, the carrier film is slightly compliant as an aid to the planarization process.

Conditioning arm 18 is a translation mechanism that moves a pad conditioning assembly comprising pad conditioner coupling 31 and end effector 32 from a rest position (away from the active polishing process) to contact of a surface of polishing media 33. Conditioning arm 18 provides both lateral and up/down movement of the pad conditioning assembly. Pad conditioner coupling 31 connects to conditioning arm 18. End effector 32 connects to pad conditioner coupling 31. A motor (not shown) rotates pad conditioner coupling 31 and end effector 32.

Conditioning arm 18 cannot consistently bring the surface of end effector 32 co-planar to the surface of polishing media 33. Pad conditioner coupling 31 provides angular compliance to maintain an abrasive surface of end effector 32 co-planar to the surface of polishing media 33 during a pad conditioning process. The abrasive surface of end effector 32 abrades the surface of polishing media 33 to achieve a flat polishing surface and remove embedded particulates to aid in chemical transport. The ability of pad conditioner coupling 31 to maintain the co-planar relationship between the surfaces of end effector 32 and polishing media 33 directly corresponds to the uniformity of a polished surface of semiconductor wafer 41. Pad conditioning allows all wafers of a wafer lot to be polished with a uniform consistency.

Chemical reactions are sensitive to temperature. It is well known that the rate of reaction typically increases with temperature. In chemical mechanical planarization, the temperature of the planarization process is held within a certain range to control the rate of reaction. The temperature is controlled by heat exchanger 38. Heat exchanger 38 is connected to platen 12 for both heating and cooling. For example, when first starting a wafer lot for planarization the temperature is approximately room temperature. Heat exchanger 38 heats platen 12 such that the CMP process is above a predetermined minimum temperature to ensure a minimum chemical reaction rate occurs. Typically, heat exchanger 38 uses ethylene glycol as the temperature transport/control mechanism to heat or cool platen 12. Running successive wafers through a chemical mechanical planarization process produces heat, for example, carrier assembly 34 retains heat. Elevating the temperature at which the CMP process occurs increases the rate of chemical reaction. Cooling platen 12 via heat exchanger 38 ensures that the CMP process is below a predetermined maximum temperature such that a maximum reaction is not exceeded.

Machine mounts 37 raise chemical mechanical planarization tool 11 above floor level to allow floor mounted drip pans where they are not integral to the polishing tool. Machine mounts 37 also have an adjustable feature to level CMP tool 11 and are designed to absorb or isolate vibrations.

Chemical mechanical planarization tool 11 is housed in an enclosure 39. As stated previously, the CMP process uses corrosive materials potentially harmful to humans and the environment. Enclosure 39 prevents the escape of particulates and chemical vapors. All moving elements of CMP tool 11 are housed within enclosure 39 to prevent injury.

Operation of chemical mechanical planarization tool 11 is described hereinbelow. No specific order of steps is meant or implied in the operating description as they are determined by a large extent to the type of semiconductor wafer polishing being implemented. Heat exchanger 38 heats platen 12 to a predetermined temperature to ensure chemicals in the slurry have a minimum reaction rate when starting a chemical mechanical planarization process. A motor drives platen 12 which puts polishing media 33 in one of rotational, orbital, or linear motion.

Wafer carrier arm 21 moves to pick up semiconductor wafer 41 located at a predetermined position. The vacuum generator is enabled to provide vacuum to carrier assembly 34. Carrier assembly 34 is aligned to semiconductor wafer 41 and moved such that a surface of carrier assembly contacts the unprocessed side of semiconductor wafer 41. Both the vacuum and carrier ring 36 hold semiconductor wafer 41 to the surface of carrier assembly 34. Carrier ring 35 constrains semiconductor wafer 41 centrally on the surface of carrier assembly 34.

Multi-input valve 14 is enabled to provide slurry to pump 15. Pump 15 provides the slurry to dispense bar manifold 16. The slurry flows through dispense bar manifold 16 to dispense bar 17 where it is delivered to the surface of polishing media 33. Periodically, deionized water valve 13 is opened to provide water through dispense bar 17 to displace the slurry to prevent it from drying, settling, or agglomerating in dispense bar 17. The motion of platen 12 aids in distributing the polishing chemistry throughout the surface of polishing media 33. Typically, slurry is delivered at a constant rate throughout the polishing process.

Wafer carrier arm 21 then returns to a position over polishing media 33. Wafer carrier arm 21 places semiconductor wafer 41 in contact with polishing media 33. Carrier assembly 34 provides angular compensation thereby placing the surface of semiconductor wafer 41 coplanar to the surface of polishing media 33. Polishing chemistry covers polishing media 33. Wafer carrier arm 21 puts downforce on semiconductor wafer 41 to promote friction between the slurry and semiconductor wafer 41. Polishing media 33 is designed for chemical transport which allows chemicals of the slurry to flow under semiconductor wafer 41 even though it is being pressed against the polishing media. As heat builds up in the system, heat exchanger 38 changes from heating platen 12 to cooling platen 12 to control the rate of chemical reaction.

It should be noted that it was previously stated that platen 12 is placed in motion in relation to semiconductor wafer 41 for mechanical polishing. Conversely, platen 12 could be in a fixed position and carrier assembly 34 could be placed in rotational, orbital, or translational motion. In general, both platen 12 and carrier assembly 34 are both in motion to aid in mechanical planarization.

Uniformity of the chemical mechanical planarization process is maintained by periodically conditioning polishing media 33. CMP tool 11 achieves better wafer polishing uniformity than currently available CMP tools used in the semiconductor industry. In particular, CMP tool 11 allows an insitu pad conditioning process which takes place during the semiconductor wafer polishing process. Furthermore, CMP tool 11 produces a more uniform flat polishing media surface at a lower cost and reduced tool downtime with a pad conditioning coupling and end effector described hereinbelow in more detail. Insitu pad conditioning increases wafer throughput by eliminating a separate pad conditioning step. Moreover, wafer polishing is more uniform and consistent since each wafer is polished under identical conditions. Referring back to FIG. 1, the arrangement of dispense bar 17, conditioning arm 18, wafer carrier arm 21, and spray bar 23 allows each assembly to function without interfering in the operation of the other devices. During the polishing process, conditioning arm 18 brings the end effector in contact with the polishing media surface. The end effector abrades the polishing media surface releasing embedded particles and spent polishing slurry as well as keeping the polishing media planar. Spray bar 23 is enabled to spray the polishing media surface with deionized water. The DI spray removes the particulates from surface of the polishing media created by the pad conditioning process. Slurry is added by dispense bar 17 to compensate for lost polishing chemistry removed by spray bar 23 during the pad conditioning process.

Referring back to FIG. 2, wafer carrier arm 21 lifts carrier assembly 34 from polishing media 33 after the chemical mechanical planarization process is completed. Wafer carrier arm 21 moves semiconductor wafer 41 to a predetermined area for cleaning. Wafer carrier arm 21 then moves semiconductor wafer 41 to a position for unloading. Vacuum generator 20 is then disabled and servo valve 19 is opened providing gas to carrier assembly 34 to eject the polished semiconductor wafer 41.

Figure 3:
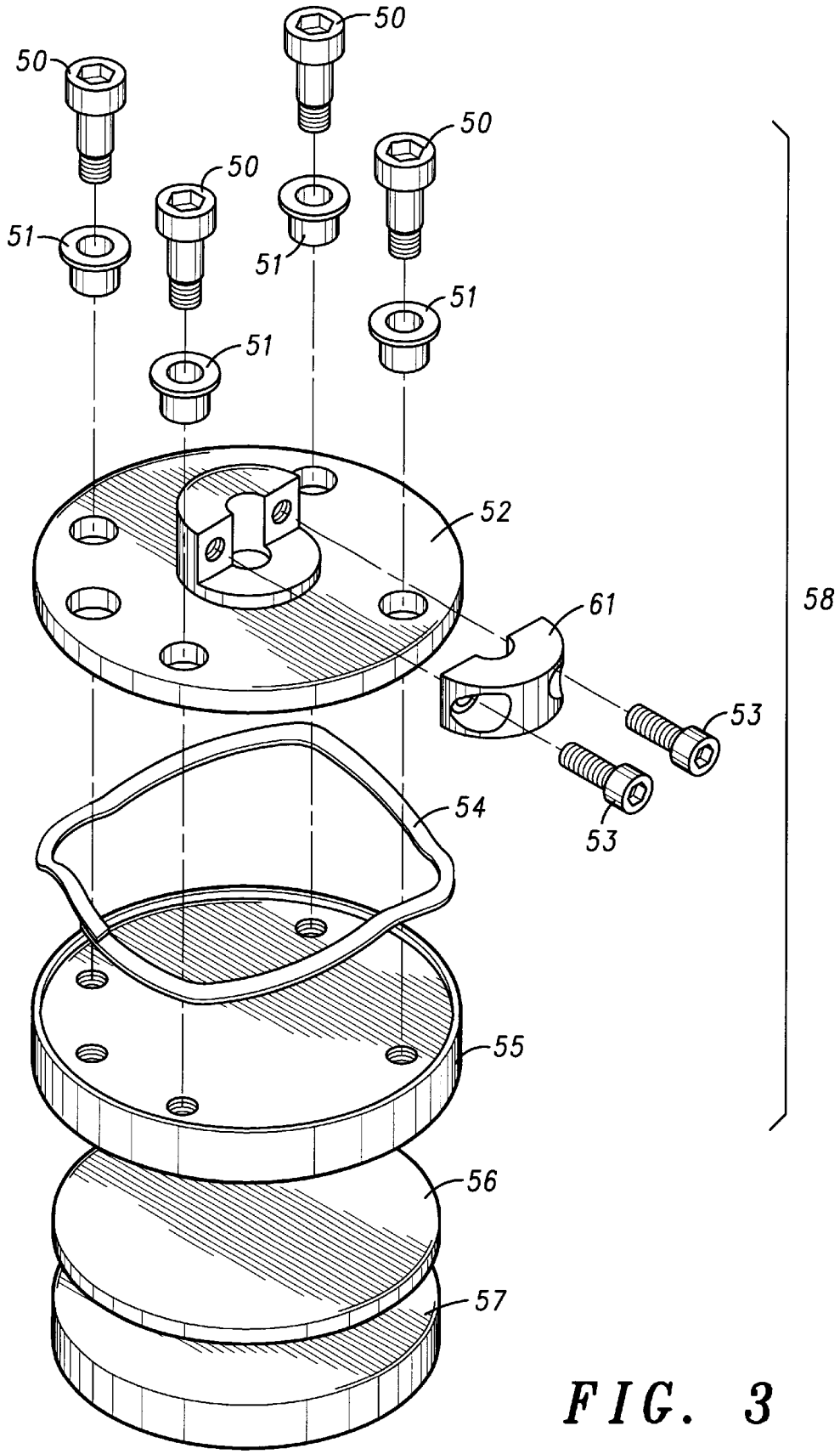
FIG. 3 is a side view of components comprising a pad conditioner coupling and end effector.

FIG. 3 is a side view of components comprising a pad conditioner coupling 58 and an end effector 57. Pad conditioner coupling 58 comprises shoulder screws 50, polymer bearings 51, a static plate 52, screws 53, a wave spring 54, and a floating plate 55. End effector 57 has an abrasive surface for abrading a surface of a polishing media. End effector 57 periodically requires replacement. The design of pad conditioner coupling 58 allows rapid removal and replacement of end effector 57 during scheduled maintenance of a CMP tool.

Ideally, pad conditioner coupling 58 is both torque rigid and angularly compliant. A motor rotates pad conditioner coupling 58 during a pad conditioning process. Torque rigidity of pad conditioner coupling 58 ensures that the torque of the motor is transferred directly into the pad conditioning process that abrades the polishing media surface. Applying the torque consistently to end effector 57 in the pad conditioning process allows the surface to be abraded evenly across the entire surface.

Angular compliance of pad conditioner coupling 58 compensates for angular differences between the plane of the abrasive surface of end effector 57 and the plane of the surface of the polishing media prior to contact. The abrasive surface of end effector 57 and the surface of the polishing media become co-planar as downforce is applied to pad conditioner coupling 58. Co-planarity of the abrasive surface of end effector 57 and the surface of the polishing media during the pad conditioning process increases the uniformity of the abrasion and resulting planarity of the polishing media surface. Polishing uniformity across a semiconductor wafer increases as a result of the better prepared polishing media surface.

Typically, both pad conditioner coupling 58 and the polishing media are rotating during a pad conditioning process. The motor driving the polishing media places a significant amount of torque, shear, and bending moment on pad conditioner coupling 58. In fact, one common failure mode for a pad conditioner coupling occurs when the abrasive surface of an end effector grabs or catches on the polishing media surface. Prior art, pad conditioner couplings often chatter, galling the surface of the polishing media if it continuously catches and releases. Moreover, the entire torque of the motor driving the polishing media is transferred to pad conditioner coupling 58 if end effector 57 grabs and does not release. The torque is transferred to pad conditioner coupling 58 resulting in a powerful bending moment around the pad conditioner coupling axis. Prior art pad conditioner couplings often catastrophically fail in this condition because they cannot withstand the torque applied by the motor. The pad conditioner coupling violently comes apart which can damage the CMP tool and produce extensive downtime for repair. Pad conditioner coupling 58 is able to withstand the full torque of the motor without fatigue or damage.

Shoulder screws 50 connect static plate 52 to floating plate 55. In an embodiment of pad conditioning coupling 58, shoulder screws 50 are made of 400-series stainless steel or other high strength materials that are impervious to a chemical mechanical planarization environment. An opening is formed in static plate 52 for each shoulder screw. Corresponding threaded openings are formed in floating plate 55. Each shoulder screw is placed through an opening in static plate 52 and screwed to a corresponding threaded opening in floating plate 55. The shaft length of shoulder screws 50 determines the maximum distance between static plate 52 and floating plate 55. The heads of shoulder screws 50 have a larger diameter than the openings formed in static plate 52 to retain static plate 52. Since static plate 52 and floating plate 55 are not rigidly fastened to one another they can move freely (in a vertical direction) to attain a non-coplanar attitude in relation to one another. This free movement allows pad conditioner coupling 58 to be angularly compliant to maintain end effector 57 co-planar to a polishing media surface.

From a rotational perspective, the positional relationship between static plate 52 and floating plate 55 is fixed by shoulder screws 50 making pad conditioner coupling 58 torque rigid. In general, the motor is chosen to have sufficient torque to eventually break free should end effector 57 grab the polishing media. The design is capable of handling torque substantially greater than the motor can supply. Thus, catastrophic failure of pad conditioner coupling 58 is eliminated which prevents unwanted CMP tool downtime and damage.

Polymer bearings 51 prevent the shafts of shoulder screws 50 from making contact with static plate 52. Metal to metal contact would increase friction and produce wear in the contact regions between static plate 52 and shoulder screws 50. Metal particles produced from the contact could fall into the polishing area of the CMP tool producing damage on the semiconductor wafer being polished. Polymer bearings 51 are formed from a low friction material which is impervious to the chemical mechanical planarization environment, for example polytetrafluoroethylene (PTFE). Polymer bearings 51 require no lubrication thus eliminating a potential source of contamination to the semiconductor wafer polishing process. Each polymer bearing is placed in an opening formed in static plate 52. In an embodiment of pad conditioner coupling 58, polymer bearings are press-fit into openings formed in static plate 52. A corresponding shoulder screw is placed through each polymer bearing. Reduced friction allows static plate 52 to easily move in relation to floating plate 55. The angular relationship between a major surface of static plate 52 and a major surface of floating plate 55 corresponds to the angular compliance of pad conditioner coupling 58. The angular compliance of pad conditioner coupling 58 allows the abrasive surface of end effector 57 to be co-planar with the polishing media surface during the pad conditioning process.

Static plate 52 comprises a first major surface and a second major surface. Static plate 52 is formed from a material that is materially strong and does not corrode in a chemical mechanical planarization environment such as passivated stainless steel. A collet is formed centrally on the first major surface. The collet is a clamp that connects to a motor shaft for rotating pad conditioner coupling 58. Screws 53 acts to tighten the collet around the motor shaft. In an embodiment of static plate 52, the major surfaces are circular. The second major surface of static plate 52 is a support structure for wave spring 54.

Wave spring 54 is placed between static plate 52 and floating plate 55. The side profile of wave spring 54 shows a somewhat sinusoidal shape having upper and lower peaks for respectively contacting static plate 52 and floating plate 55. A top view of wave spring 54 would show a circular shape. Wave spring 54 applies a force to separate static plate 52 from floating plate 55. The length of a shaft of each shoulder screw is less than the distance between an upper and lower peak of wave spring 54. Thus, wave spring 54 is compressed when shoulder screws 50 are fastened to floating plate 55. In an embodiment of pad conditioner coupling 58, wave spring 54 is made from a passivated stainless steel spring material.

Wave spring 54 plays a dual role in the pad conditioning process. First, wave spring 54 allows pad conditioner coupling 58 to be angularly compliant when pad conditioner coupling 58 is brought down such that the second major surface of static plate 52 is non-parallel to the surface of the polishing media. Wave spring 54 non-uniformly compresses to maintain co-planarity between the abrasive surface of end effector 57 and the surface of the polishing media. Second, wave spring 54 allows sufficient downforce to be applied to pad conditioner coupling 58 for the pad conditioning process. The design of wave spring 54 ensures that both the angular compliance and downforce conditions are met. The force required to compress wave spring 54 is linear with respect to distance. In particular, the force required to compress wave spring 54 increases the more it is compressed. Thus, the minimum force to compress the initial distance occurs when end effector 57 first becomes compliant to the polishing media. This is ideal since pad conditioner coupling 58 is most angularly compliant when end effector 57 first contacts the polishing media to achieve co-planarity. Additional force is applied to promote abrasive removal of the contaminants resulting from the semiconductor wafer polishing process as well as to planarize the polishing media. The linear spring constant of wave spring 54 allows this additional force to be applied to pad conditioner coupling 58 without causing contact between static plate 52 and floating plate 55.

A coil or compression spring is not suitable for pad conditioner coupling 58. For example, the coils of a compression spring would have to be approximately 0.32 centimeters in diameter to provide similar compression characteristics. The compression spring would be larger, heavier, and would cause a reduction in angular compliance. Moreover, additional parts would be required (more complex) having more wear points which would generate more particulates thus contaminating the CMP environment. In addition, more complex assembly would be more difficult to clean.

Floating plate 55 comprises a first major surface and a second major surface. The first major surface of floating plate 55 is a support structure for wave spring 54. The second major surface of floating plate 55 is a support structure for end effector 57. In an embodiment of pad conditioner coupling 58, floating plate 55 is circular in shape. Floating plate 55 is formed from a material that is materially strong and does not corrode in a chemical mechanical planarization environment such as passivated stainless steel.

Double-sided film 56 is used to attach end effector 57 to floating plate 55. Double-sided film 56 has an adhesive on both sides of the film. Double-sided film 56 is compliant which aids in the pad conditioning process. Double-sided film 56 is adhesively attached to the second major surface of floating plate 55. It should be noted that double-sided film is not permanently attached to floating plate 55 but is removeable when end effector 57 is replaced.

End effector 57 comprises a planar surface and an abrasive surface. In an embodiment of pad conditioner coupling 58, end effector 57 is circular in shape. The planar surface is attached to the exposed adhesive surface of double-sided film 56. The abrasive surface of end effector 57 is used to abrade the polishing media during a pad conditioning process.

An alternative to adhesively attaching end effector 57 to floating plate 55 is a press fit. An area for retaining end effector 56 is formed in the second surface of floating plate 55. The area in floating plate 55 is shaped similar to the planar surface of end effector 57 but is designed for an interference fit when end effector 57 is pressed into floating plate 55.

Figure 4:
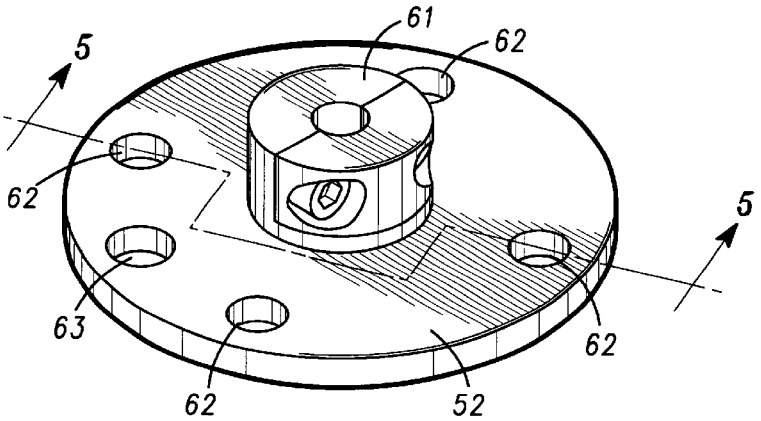
FIG. 4 is a top view of the static plate illustrated in FIG. 3.

FIG. 4 is a top view of static plate 52 illustrated in FIG. 3. The top view illustrates the circular shape of static plate 52, a collet 61, shoulder screw holes 62, and access hole 63. Collet 61 is centrally located in static plate 52. An opening is formed in collet 61 for receiving and holding a motor shaft. Shoulder screw holes 62 are formed concentrically around the periphery of static plate 52. The placement is symmetrical for balance when static plate 52 is rotated. A polymer bearing (not shown) is press fit in each of the shoulder screw holes 62. Access hole 63 allows a tool to be placed through static plate 52 for the removal of end effector 57 of FIG. 3.

Figure 5:
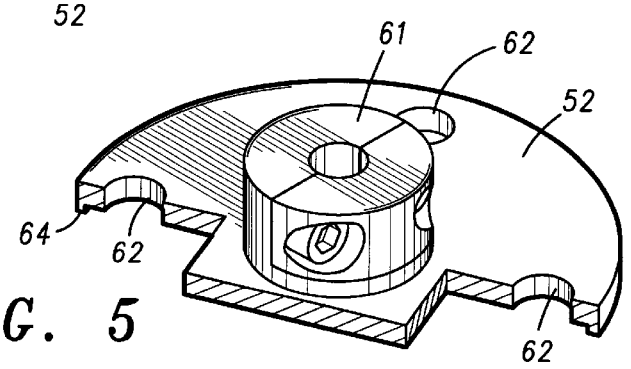
FIG. 5 is a cross-sectional side view of the static plate of FIG. 4.

FIG. 5 is a cross-sectional side view of static plate 52 of FIG. 4. A retaining lip 64 is formed on the outer edge of the second major surface of static plate 52. Retaining lip 64 is a retaining structure for wave spring 54. Wave spring 54 of FIG. 3 has an outer diameter smaller than the inner diameter of retaining lip 64. Wave spring 54 (FIG. 3) fits within retaining lip 64. The upper peaks of wave spring 54 (FIG. 3) contacts the second major surface of static plate 52. Retaining lip 64 prevents wave spring 54 (FIG. 3) from expanding outward unacceptably (increase in outer diameter) as it is being compressed.

Figure 6:
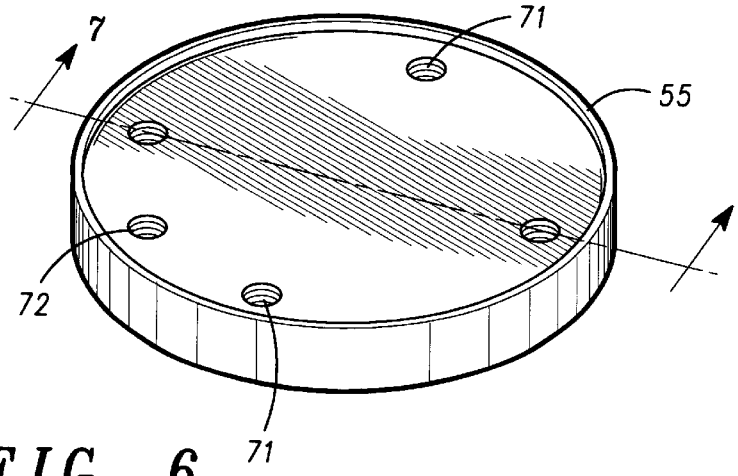
FIG. 6 is a top view of the floating plate illustrated in FIG. 3.

FIG. 6 is a top view of floating plate 55 of FIG. 3. The top view illustrates the circular shape of floating plate 55, an upper retaining lip 73, threaded openings 71, and threaded hole 72. Upper retaining lip 73 is formed around the circumference of floating plate 55 for retaining wave spring 54 of FIG. 3. Threaded openings 71 correspond to, and line up with shoulder screw holes 62 of FIG. 4. Threaded openings 71 are concentrically placed near the periphery of floating plate 55. Threaded openings 71 are tapped to a screw thread pattern and receive shoulder screws 50 of FIG. 3. Threaded hole 72 is designed to hold a screw which is used to remove end effector 57 of FIG. 3. For example, an Allen headed fastener is screwed in threaded hole 72. The length of a shaft of Allen headed fastener is greater than the thickness of floating plate 55. An Allen wrench is inserted through access hole 63 of FIG. 4 to the Allen headed fastener and advanced through floating plate 55. The Allen headed fastener will break loose end effector 57 of FIG. 3 as the Allen headed fastener extends through floating plate 55 allowing for its rapid removal and replacement.

Figure 7:
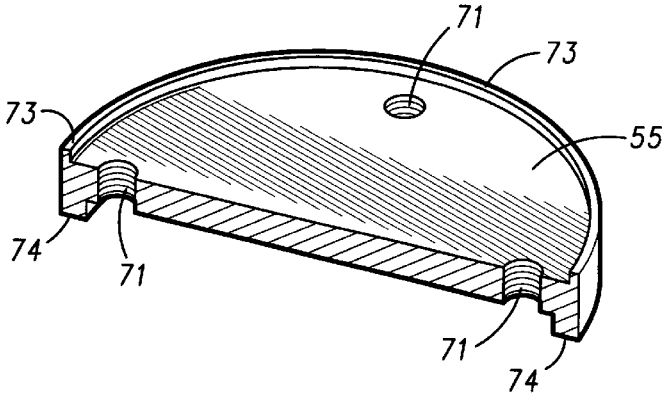
FIG. 7 is a cross-sectional side view of the floating plate of FIG. 6.

FIG. 7 is a cross-sectional side view of floating plate 55 of FIG. 6. The cross-sectional side view illustrates upper retaining lip 73, threaded openings 71, and a lower retaining lip 74. Upper retaining lip 73 is formed on the outer edge of floating plate 55. Upper retaining lip 73 is a retaining structure for wave spring 54. Wave spring 54 of FIG. 3 has an outer diameter smaller than the inner diameter of upper retaining lip 73. Wave spring 54 (FIG. 3) fits within upper retaining lip 73. The lower peaks of wave spring 54 (FIG. 3) contact the first major surface of floating plate 55. Upper retaining lip 73 prevents wave spring 54 (FIG. 3) from expanding outward unacceptably (increase in outer diameter) as it is being compressed.

Shoulder screws 50 of FIG. 3 screw into threaded openings 71. The threaded portion of shoulder screws 50 (FIG. 3) has a length less than the thickness of floating plate 55. Thus, shoulder screws 50 (FIG. 3) do not extend through floating plate 55.

Lower retaining lip 74 is also formed on the outer edge of floating plate 55. Double-sided film 56 of FIG. 3 is adhesively attached to the second major surface of floating plate 55. End effector 57 of FIG. 3 adhesively attaches to the exposed side of double-sided film 56 (FIG. 3). Lower retaining lip 74 retains end effector 57 (FIG. 3) from moving from floating plate 55. Alternately, the diameter of end effector 57 (FIG. 3) can be designed for an interference fit with lower retaining lip 74. End effector 57 (FIG. 3) is then press fit to the second major surface and is retained without the need of double-sided film 56 (FIG. 3).

Figure 8:
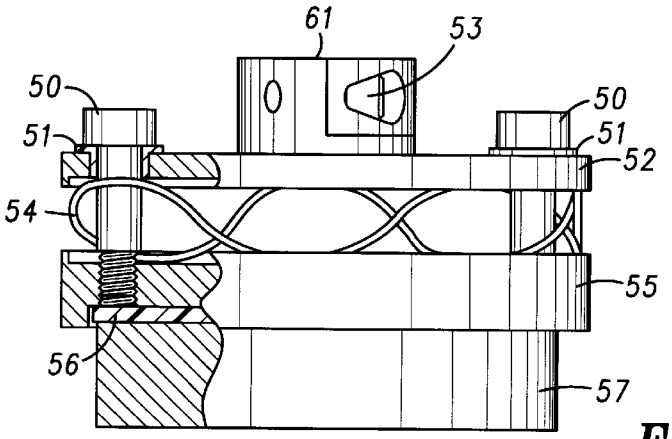
FIG. 8 is the pad conditioner coupling and end effector of FIG. 3 assembled.

FIG. 8 is pad conditioner coupling 58 and end effector 57 of FIG. 3 in an assembled state. Pad conditioner coupling 58 comprises static plate 52, wave spring 54, floating plate 55, polymer bearings 51, shoulder screws 50, and screws 53. Wave spring 54 is placed between static plate 52 and floating plate 55 but does not protrude from the second surface of static plate 52. Polymer bearings 50 are placed in openings of static plate 52. Each shoulder screw is placed through a polymer bearing and static plate 52 and fastened to floating plate 55. Fastening shoulder screws 50 compresses wave spring 54 placing a force on both static plate 52 and floating plate 55. Double-sided film 56 attaches end effector 57 to floating plate 55.

Pad conditioner coupling 58 is designed to withstand worst case conditions in a pad conditioning process. The height of pad conditioner coupling 58 impacts the tipping moment. In general, a low height is desirable to minimize tipping moment caused by the force that can be applied to the apparatus via the rotating polishing media. Prior art, pad conditioner couplings typically have a height less than 5 centimeters. For example, pad conditioner coupling 58 for a 200 millimeter semiconductor wafer application has a height of approximately 3.0 centimeters which allows retrofitting into currently available equipment.

Calculations of the forces that are placed on a typical pad conditioning apparatus require design formula utilizing parameters from several CMP components. First and second variables are the torque rating and revolutions per minute of a motor that drives a polishing platen. The platen is a support structure for the polishing media. A third variable is a gearbox reduction unit which is used to reduce the revolutions per minute at the platen. There are efficiency losses in both the motor and gearbox that should be taken into account to prevent significantly overdesigning pad conditioner coupling 58. A fourth variable is the platen diameter. A fifth variable is the coefficient of sliding friction corresponding to end effector 57 moving against the polishing media. A sixth variable is the worstcase downforce applied to pad conditioner coupling 58 during the pad conditioning process. A final design consideration is the diameter of end effector 57. For example, static plate 52 and floating plate 55 each have a diameter of approximately 5 centimeters for a 200 millimeter semiconductor wafer application. The 5 centimeter diameter allows sufficient abrasive surface area for the pad conditioning process yet has a sufficiently small foot print to promote insitu pad conditioning during wafer polishing. Using the above listed parameters, the maximum torque load and maximum side loading on pad conditioner coupling 58 can be calculated.

The limiting factor on making pad conditioner coupling 58 torque rigid are shoulder screws 50. Shoulder screws 50 cannot bend or pull out under maximum torque and side loading. The shafts of shoulder screws 50 for a 200 millimeter semiconductor wafer CMP process are approximately 0.8 centimeters in diameter which is significantly overdesigned for the application. Similarly, shoulder screws 50 have sufficient thread engagement and cross-sectional area such that pull out is never a problem under anticipated loading conditions.

Static plate 52 and floating plate 55 must be strong enough to resist dynamic flexing or permanent bending under all conditions. Another design factor affecting plate thickness is chatter. Prior art, pad conditioner couplings were found to vibrate due to slip/stick action during the pad conditioning process. The vibration produced variations in the abrasion of the polishing media surface which reduced polishing media uniformity and planarity. As mentioned hereinabove, the uniformity and planarity of the polishing media directly impacts the uniformity of a semiconductor wafer being polished on the polishing media surface. Static plate 52 and floating plate 55 have a thickness of approximately 0.65 centimeters for a 200 millimeter semiconductor wafer CMP process. The thickness is selected to give floating plate 55 sufficient mass to dampen vibration. Dampening the vibration problem also eliminates the flexing or bending problems because the selected thickness to solve the former problem is substantially greater than required to solve the latter problems.

As mentioned hereinabove, wave spring 54 serves a dual role. First, wave spring 54 provides angular compliance such that end effector 57 becomes coplanar to the polishing media surface. Second, wave spring 54 prevents static plate 52 from contacting floating plate 55 as more force is applied to pad conditioner coupling 58 during the pad conditioning process. The characteristics run counter to one another when defining how wave spring 54 should be made. A compromise between compliance and stiffness is first determined by selecting a maximum angle that pad conditioner coupling 58 must compensate for in the CMP tool. For example, an angular compliance requirement of 5 degrees or less is suitable for CMP tools currently used to polish 200 millimeter semiconductor wafers. The 5 degree target was selected because a human trying to make the abrasive surface of end effector 58 parallel to the polishing media by eyesight can meet the 5 degree requirement.

The number of inflection points in wave spring 54 affects the angular compliance as well as total deflection under downforce loading of pad conditioner coupling 58. The best compliance without allowing static plate 52 to touch floating plate 55 (when under maximum anticipated loading) is achieved with the fewest number of inflection points. For example, pad conditioner coupling 58 for a 200 millimeter semiconductor wafer CMP tool has 6 inflection points comprising 3 upper inflection points and 3 lower inflection points. This allows for symmetrical and planar loading of floating plate 55 in relation to static plate 52. The height of wave spring 54 is calculated by taking the defined height of pad conditioner coupling 58 (for example, 3.0 centimeters) and subtracting the combined heights of static plate 52 and floating plate 55 and then adding the required deflection for spring preload. In an embodiment of pad conditioner coupling 58, the outer diameter of wave spring 54 is restrained by static plate 52 and floating plate 55 while the inner diameter is concentrically restrained by shoulder screws 50.

The spring rate of wave spring 54 is selected to have a safety margin of 1.5. For example, maximum downforce applied to pad conditioner coupling in a pad conditioning process is X. Wave spring 54 is chosen such that static plate 52 and floating plate contact one another under a downforce one and half times × (1.5×). For example, wave spring 54 comprising 17-7 PH stainless steel in condition C/CH900, 5 centimeter outer diameter having 3 waves (six inflection points), and a free height of approximately 0.9 centimeters requires a wire thickness of approximately 0.047 centimeters and a width of 0.025 centimeters to meet the safety margin.

Wave spring 54 must be preloaded (compressed) under quiescent conditions. The preload increases the fatigue life of wave spring 54. The stress on wave spring 54 is calculated under maximum loading. Calculating the resultant deflection will determine if wave spring 54 is functional under maximum loading. The fatigue life of wave spring 54 is derived from the stress calculation conditions of operation from a preload to using maximum loading. In an embodiment of pad conditioner coupling 58, the preload on wave spring 54 allows a cycle life greater than 1,000,000 which meets production requirements under maximum loading.

By now it should be appreciated that a chemical mechanical planarization tool has been provided for insitu pad conditioning during a wafer polishing process that improves the semiconductor wafer uniformity in a production environment. A pad conditioner coupling has been provided that is torque rigid and does not twist, flex, bend, or chatter under worst case semiconductor wafer polishing conditions. The pad conditioner coupling is also angular compliant such that an end effector maintains coplanarity with a polishing media surface during a pad conditioning process. A wave spring is used in the pad conditioner coupling for angular compliance.

What is claimed is:

1. A pad conditioner coupling having angular compliance and torque rigidity comprising:

a first support structure having a first major surface and a second major surface;

a wave spring coupled to said second major surface of said first support structure said wave spring having an upper peak and a lower peak;

a second support structure having a first major surface coupled to said wave spring and a second major surface; and a plurality of shoulder screws slidingly extended through the first support structure and fastened to a corresponding opening in the second support structure in order to vary an angle between the first and second support structures to provide a torque rigid and angular compliant pad conditioner.

2. The pad conditioner coupling of claim 1 wherein said first support structure, said wave spring, and said second support structure are formed from stainless steel.

3. The pad conditioner coupling of claim 1 further including a collet centrally located on said first major surface of said first support structure.

4. The pad conditioner coupling of claim 1 wherein said second major surface of said first support structure includes a retaining structure for said wave spring.

5. The pad conditioner coupling of claim 1 wherein said first major surface of said second support structure includes a retaining structure for said wave spring.

6. The pad conditioner coupling of claim 1 wherein said wave spring includes three upper surfaces for coupling to said second major surface of said first support structure and three lower surfaces for coupling to said first major surface of said second support structure.

7. The pad conditioner coupling of claim 1 wherein said second major surface of said first support structure is a predetermined distance from said first major surface of said second support structure under quiescent conditions to preload said wave spring.

8. The pad conditioner coupling of claim 7 wherein said predetermined distance between said second major surface of said first support structure and said first major surface of said second support structure is determined by a shaft length of said plurality of shoulder screws and wherein said shaft length is less than a distance between the upper peak and the lower peak of the wave spring.

9. The pad conditioner coupling of claim 7 wherein a plurality of holes are concentrically formed in said first support structure, wherein a plurality of openings are formed concentrically in said second support structure, wherein said plurality of holes in said first support structure align with said plurality of openings in said second support structure, and wherein said plurality of openings in said second support structure are tapped.

10. The pad conditioner coupling of claim 9 further including:

a plurality of polymer bearings wherein each polymer bearing is placed in a corresponding hole of said first support structure and wherein each of the shoulder screws is placed through a corresponding polymer bearing and fastened to the corresponding opening in said second support structure.

11. The pad conditioner coupling of claim 1 further including a double-sided film adhesively coupled to said second major surface of said second support structure.

12. The pad conditioner coupling of claim 11 further including an end effector having a planar surface and an abrasive surface wherein said planar surface of said end effector is adhesively coupled to said double-sided film.

* * * * *